US009382691B2

(12) United States Patent
Kawashima et al.

(10) Patent No.: US 9,382,691 B2
(45) Date of Patent: Jul. 5, 2016

(54) HYBRID WORK MACHINE AND METHOD OF CONTROLLING SAME

(71) Applicants: SUMITOMO HEAVY INDUSTRIES, LTD., Tokyo (JP); SUMITOMO(S.H.I.) CONSTRUCTION MACHINERY CO., LTD., Tokyo (JP)

(72) Inventors: Koji Kawashima, Kanagawa (JP); Yuta Sugiyama, Kanagawa (JP); Hideto Magaki, Chiba (JP); Kiminori Sano, Chiba (JP); Ryuji Shiratani, Chiba (JP)

(73) Assignees: SUMITOMO HEAVY INDUSTRIES, LTD., Tokyo (JP); SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 253 days.

(21) Appl. No.: 14/101,487

(22) Filed: Dec. 10, 2013

(65) Prior Publication Data

US 2014/0107898 A1 Apr. 17, 2014

Related U.S. Application Data

(63) Continuation of application No. PCT/JP2012/066065, filed on Jun. 22, 2012.

(30) Foreign Application Priority Data

Jun. 27, 2011 (JP) ..... 2011-142340

(51) Int. Cl.
*E02F 3/85* (2006.01)
*E02F 9/12* (2006.01)
*E02F 9/20* (2006.01)

(52) U.S. Cl.
CPC ..... *E02F 9/123* (2013.01); *E02F 9/2033* (2013.01); *E02F 9/2095* (2013.01)

(58) Field of Classification Search
None
See application file for complete search history.

(56) References Cited

U.S. PATENT DOCUMENTS 8,087,240 B2 1/2012 Morinaga et al.
8,612,102 B2 * 12/2013 Ohhigashi ..... E02F 9/2075 414/687

(Continued)

FOREIGN PATENT DOCUMENTS

GB 2431738 5/2007
JP 2008-088659 4/2008

(Continued)

OTHER PUBLICATIONS

International Search Report mailed on Sep. 25, 2012.

*Primary Examiner* — Rami Khatib
*Assistant Examiner* — Navid Ziaeianmehdizadeh
(74) *Attorney, Agent, or Firm* — IPUSA, PLLC

(57) ABSTRACT

A hybrid work machine includes a turning electric motor configured to turn an upper-part turning body, a hydraulic actuator, and a controller configured to control turning in a state of an independent turning operation by the turning electric motor and in a state of a combined turning operation by the turning electric motor and the hydraulic actuator. The controller is configured to limit the output of the turning electric motor in the state of the independent turning operation after a transition from the state of the combined turning operation to the state of the independent turning operation to an output smaller than the output of the turning electric motor in the state of the independent turning operation other than the state of the independent turning operation after said transition.

12 Claims, 8 Drawing Sheets

(56) References Cited

U.S. PATENT DOCUMENTS

| | | | | |
|---|---|---|---|---|
| 8,788,156 | B2 * | 7/2014 | Nishimura | B60W 10/06 414/699 |
| 8,880,265 | B2 * | 11/2014 | Goto | E02F 9/2075 701/22 |
| 8,909,434 | B2 * | 12/2014 | Anders | E02F 9/2075 701/50 |
| 8,924,100 | B2 * | 12/2014 | Imura | B60W 10/06 701/36 |
| 8,977,443 | B2 * | 3/2015 | Nakamura | B60W 10/08 701/50 |
| 2008/0018271 | A1 | 1/2008 | Morinaga et al. | |
| 2008/0082240 | A1 | 4/2008 | Kagoshima et al. | |
| 2009/0301075 | A1 * | 12/2009 | Morinaga | B66C 1/42 60/459 |
| 2010/0115938 | A1 * | 5/2010 | Kobata | E02F 9/2203 60/422 |
| 2010/0167873 | A1 * | 7/2010 | Akiyama | F02D 41/083 477/68 |
| 2011/0167811 | A1 * | 7/2011 | Kawaguchi | E02F 9/2246 60/395 |
| 2011/0254513 | A1 * | 10/2011 | Kagoshima | B60W 30/1888 320/162 |
| 2012/0109472 | A1 * | 5/2012 | Yanagisawa | B60K 6/46 701/50 |
| 2012/0296510 | A1 * | 11/2012 | Kawashima | B60W 10/08 701/22 |
| 2013/0004280 | A1 * | 1/2013 | Zhang | E02F 9/123 414/687 |
| 2014/0166135 | A1 * | 6/2014 | Yamashita | E02F 9/123 137/565.16 |

FOREIGN PATENT DOCUMENTS

| | | |
|---|---|---|
| JP | 2009-068245 | 4/2009 |
| JP | 2010-106512 | 5/2010 |
| JP | 2010-189864 | 9/2010 |
| JP | 2011-094451 | 5/2011 |
| WO | WO 2007/052538 | 5/2007 |

* cited by examiner

HYBRID WORK MACHINE AND METHOD OF CONTROLLING SAME

CROSS-REFERENCE TO RELATED APPLICATIONS

The present application is a continuation application filed under 35 U.S.C. 111(*a*) claiming benefit under 35 U.S.C. 120 and 365(*c*) of PCT International Application No. PCT/JP2012/066065, filed on Jun. 22, 2012 and designated the U.S., which claims priority to Japanese Patent Application No. 2011-142340, filed on Jun. 27, 2011. The entire contents of the foregoing applications are incorporated herein by reference.

BACKGROUND

1. Technical Field

The present invention relates to a hybrid work machine and a method of controlling the same.

2. Description of Related Art

A hybrid shovel has been known that includes hydraulic cylinders that drive working elements such as a boom, an arm, and a bucket and a turning motor generator that drives an upper-part turning body.

This hybrid shovel causes a hydraulic boom cylinder and the turning motor generator to operate in combination in order to dig earth and sand below with the bucket, thereafter causes the upper-part turning body to turn a predetermined angle while raising the boom, and load the bed of a dump truck with dug-out earth and sand. At this point, the hybrid shovel causes the boom raising speed and the turning speed of the upper-part turning body to match by reducing a maximum turning speed from a maximum turning speed at a normal time to a maximum turning speed at a combined-operation time. In this manner, the hybrid shovel has the boom raised to the height of the bed of the dump truck at the exact time that the upper-part turning body has turned to the bed of the dump truck.

SUMMARY

According to an aspect of the present invention, a hybrid work machine includes a turning electric motor configured to turn an upper-part turning body; a hydraulic actuator; and a controller configured to control turning in a state of an independent turning operation by the turning electric motor and in a state of a combined turning operation by the turning electric motor and the hydraulic actuator, wherein the controller is configured to limit an output of the turning electric motor in the state of the independent turning operation after a transition from the state of the combined turning operation to the state of the independent turning operation to an output smaller than an output of the turning electric motor in the state of the independent turning operation other than the state of the independent turning operation after said transition.

According to an aspect of the present invention, a method of controlling a hybrid work machine, which includes a turning electric motor configured to turn an upper-part turning body, a hydraulic actuator, and a controller configured to control turning in a state of an independent turning operation by the turning electric motor and in a state of a combined turning operation by the turning electric motor and the hydraulic actuator, includes limiting, by the controller, an output of the turning electric motor in the state of the independent turning operation after a transition from the state of the combined turning operation to the state of the independent turning operation to an output smaller than an output of the turning electric motor in the state of the independent turning operation other than the state of the independent turning operation after said transition.

The object and advantages of the invention will be realized and attained by means of the elements and combinations particularly pointed out in the claims.

It is to be understood that both the foregoing general description and the following detailed description are exemplary and explanatory and not restrictive of the invention.

BRIEF DESCRIPTION OF THE DRAWINGS

Other objects, features and advantages of the present invention will become more apparent from the following detailed description when read in conjunction with the accompanying drawings, in which.

DETAILED DESCRIPTION

International Publication Pamphlet No. WO 07/052538, however, does not disclose an operation at the time of causing the turning motor generator alone to continuously operate independently after the completion of the combined operation of the hydraulic boom cylinder and the turning motor generator, nor does it disclose the transition of the turning speed of the upper-part turning body at the time of switching from the combined operation to the independent operation.

According to an aspect of the present invention, a hybrid work machine and a method of controlling the same are provided that increase operability at the time of the switching of a combined operation of a hydraulic actuator and a turning electric motor and an independent operation of the turning electric motor.

A description is given, with reference to the accompanying drawings, of embodiments of the present invention.

Figure 1:
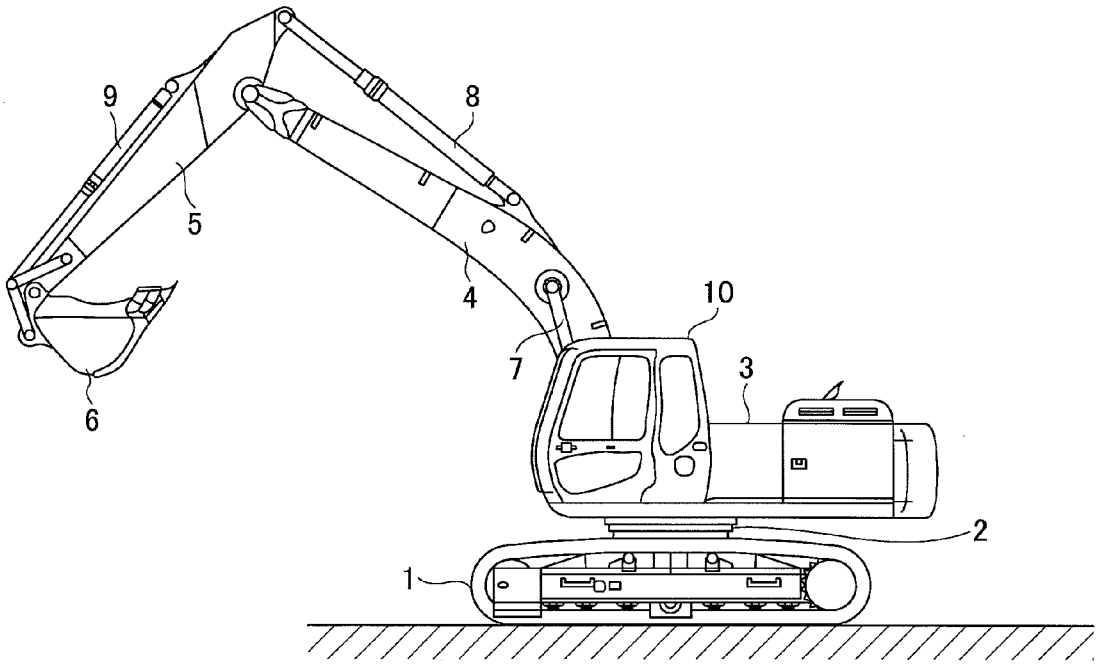
FIG. 1 is a side view of a hybrid shovel according to an embodiment.

FIG. 1 is a side view illustrating a hybrid shovel according to an embodiment, which is an example of a hybrid work machine to which the present invention is applied.

An upper-part turning body 3 is mounted through a turning mechanism 2 on a lower-part traveling body 1 of the hybrid shovel. A boom 4 is attached to the upper-part turning body 3. An arm 5 is attached to the end of the boom 4. A bucket 6 is attached to the end of the arm 5. The boom 4, the arm 5, and the bucket 6 are hydraulically driven by a boom cylinder 7, an arm cylinder 8, and a bucket cylinder 9, respectively. A cabin 10 is provided on and power sources such as an engine are mounted on the upper-part turning body 3.

Figure 2:
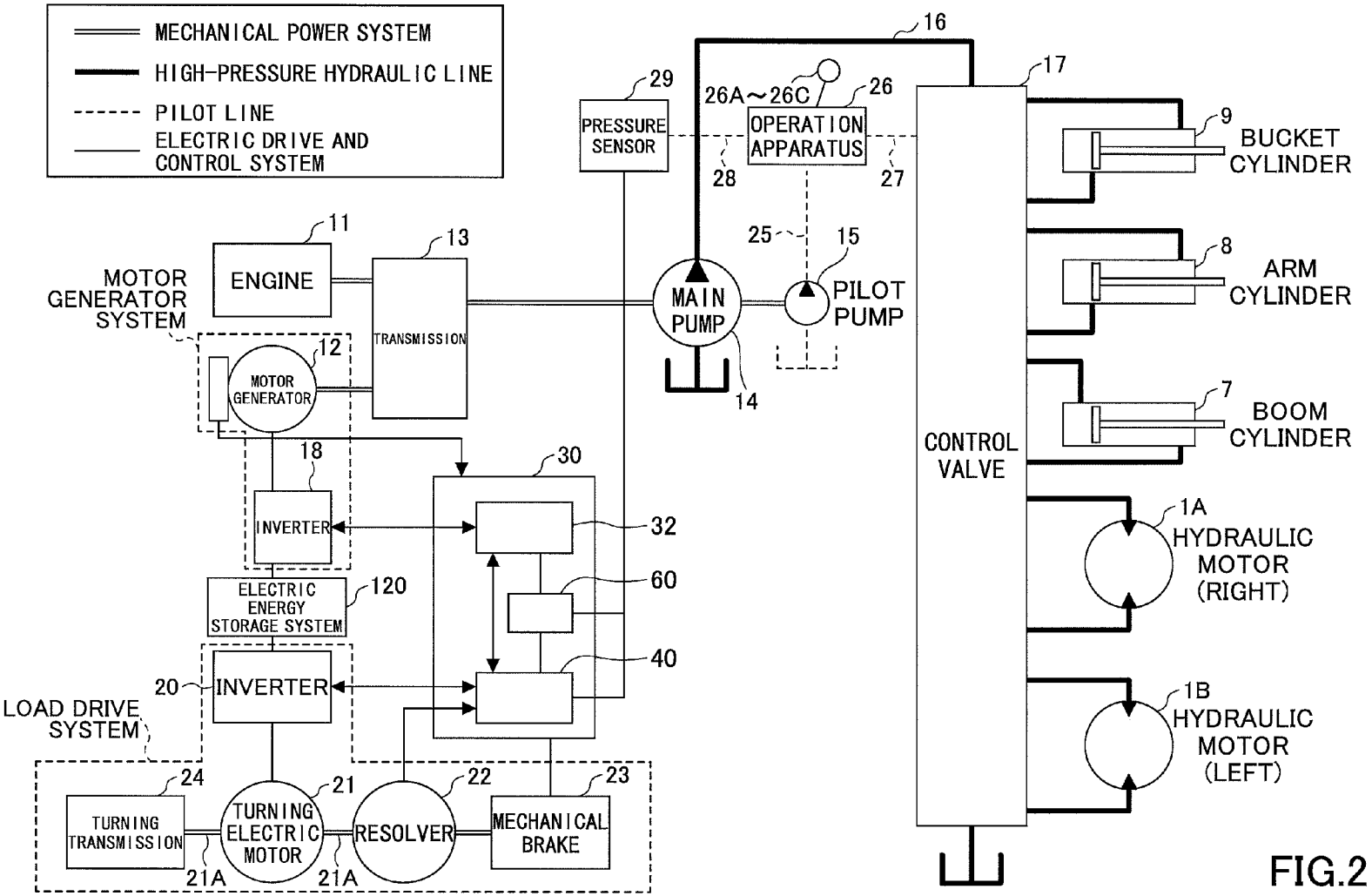
FIG. 2 is a block diagram illustrating a configuration of a drive system of a hybrid shovel according to the embodiment.

FIG. 2 is a block diagram illustrating a configuration of a drive system of the hybrid shovel illustrated in FIG. 1. In FIG. 2, a mechanical power system, a high-pressure hydraulic line, a pilot line, and an electric drive and control system are indicated by a double line, a solid line (a bold line), a broken line, and a solid line (a fine line), respectively.

An engine 11 as a mechanical drive part and a motor generator 12 as an assist drive part are connected to a first input shaft and a second input shaft, respectively, of a transmission 13. A main pump 14 and a pilot pump 15 are connected as hydraulic pumps to the output shaft of the transmission 13. A control valve 17 is connected to the main pump 14 via a high-pressure hydraulic line 16. The hydraulic pump 14 is a swash-plate variable displacement hydraulic pump, and its discharge flow rate may be controlled by adjusting the stroke length of a piston by controlling the angle of a swash plate (a tilt angle).

The control valve 17 is a control device that controls a hydraulic system in the hybrid shovel. Hydraulic motors 1A (right) and 1B (left) for the lower-part traveling body 1, the boom cylinder 7, the arm cylinder 8, and the bucket cylinder 9 are connected to the control valve 17 via high-pressure hydraulic lines. Hereinafter, the hydraulic motors 1A (right) and 1B (left), the boom cylinder 7, the arm cylinder 8, and the bucket cylinder 9 are collectively referred to as "hydraulic actuator."

An electric energy storage system 120 including an electric energy storage device is connected to the motor generator 12 via an inverter 18. The motor generator 12 and the inverter 18 constitute a motor generator system. Furthermore, an operation apparatus 26 is connected to the pilot pump 15 via a pilot line 25. The operation apparatus 26 includes a turning operation lever 26A, a hydraulic actuator operation lever 26B, and a hydraulic actuator operation pedal 26C. The turning operation lever 26A, the hydraulic actuator operation lever 26B, and the hydraulic actuator operation pedal 26C are connected to the control valve 17 and a pressure sensor 29 via hydraulic lines 27 and 28, respectively. The pressure sensor 29 is connected to a controller 30 that controls the driving of an electric system.

The hybrid shovel illustrated in FIG. 2, which has an electric turning mechanism, is provided with a turning electric motor 21 in order to drive the turning mechanism 2. The turning electric motor 21 as an electric working element is connected to the electric energy storage system 120 via an inverter 20. A resolver 22, a mechanical brake 23, and a turning transmission 24 are connected to a rotating shaft 21A of the turning electric motor 21. The inverter 20, the turning electric motor 21, the resolver 22, the mechanical brake 23, and the turning transmission 24 constitute a load drive system.

The controller 30 includes a processor including a CPU (Central Processing Unit) and an internal memory.

The controller 30 controls the operation (switches the electric motor [assist] operation and the generator operation) of the motor generator 12, and controls the operation (switches the power running operation and the regenerative operation) of the turning electric motor 21. Furthermore, the controller 30 controls the charge and discharge of an electric energy storage device (a capacitor) by controlling the driving of a step-up/step-down converter as a step-up/step-down control part.

Specifically, the controller 30 controls the charge and discharge of the electric energy storage device (capacitor) by controlling the switching of the step-up operation and the step-down operation of the step-up/step-down converter based on the state of charge of the electric energy storage part (capacitor), the operating state (electric motor [assist] operation or generator operation) of the motor generator 12, and the operating state (power running operation or regenerative operation) of the turning electric motor 21.

The switching of the step-up operation and the step-down operation of the step-up/step-down converter is controlled based on a DC bus voltage value detected by a DC bus voltage detecting part provided to a DC bus, an electric energy storage device voltage value detected by an electric energy storage device voltage detecting part, and an electric energy storage device current value detected by an electric energy storage device current detecting part.

Furthermore, the SOC (State Of Charge) of the electric energy storage device (capacitor) is calculated based on the electric energy storage device voltage value detected by the electric energy storage device voltage detecting part. Furthermore, a capacitor is illustrated above as an example of the electric energy storage device. Alternatively, in place of a capacitor, a rechargeable battery, which is chargeable and dischargeable, such as a lithium ion battery or other form of power supply capable of transferring electric power may also be used as the electric energy storage device.

Figure 3:
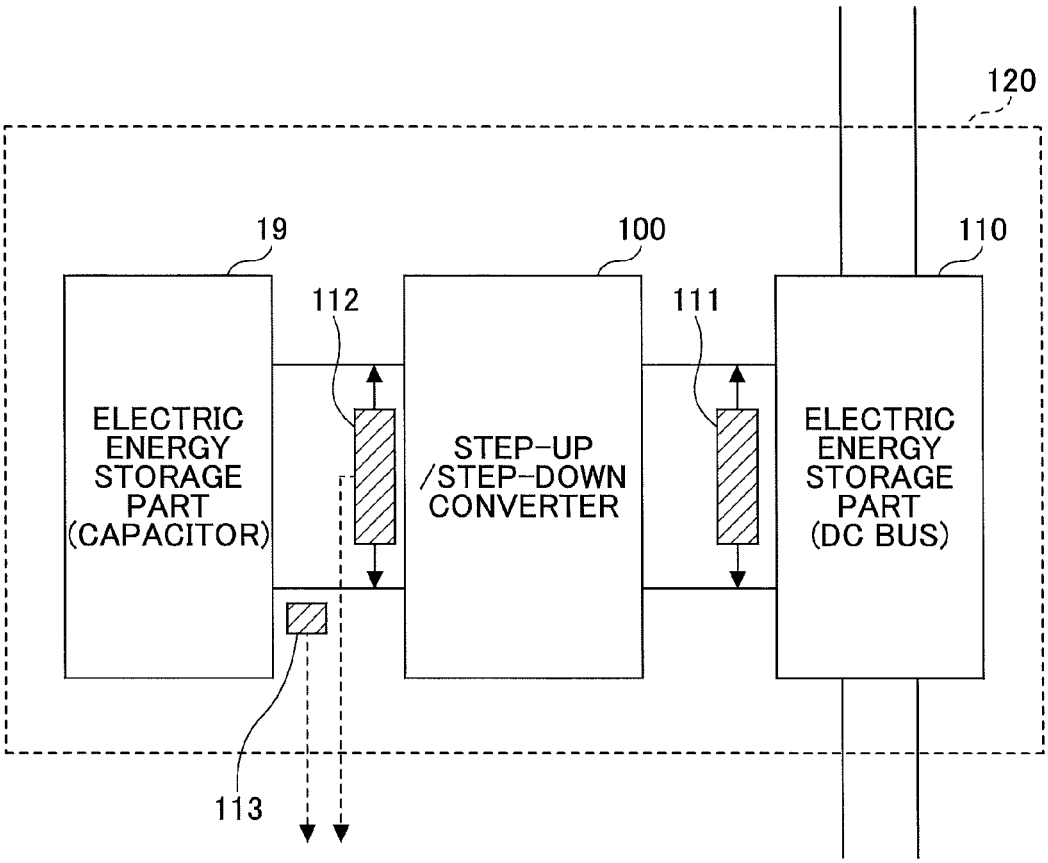
FIG. 3 is a block diagram illustrating a configuration of an electric energy storage system of a hybrid shovel according to the embodiment.

FIG. 3 is a block diagram illustrating a configuration of the electric energy storage system 120. The electric energy storage system 120 includes a capacitor 19 as an electric energy storage device, a step-up/step-down converter 100, and a DC bus 110. The DC bus 110 controls the transfer of electric power among the capacitor 19, the motor generator 12, and the turning electric motor 21. The capacitor 19 is provided with a capacitor voltage detecting part 112 for detecting a capacitor voltage value and a capacitor current detecting part 113 for detecting a capacitor current value. The capacitor voltage value detected by the capacitor voltage detecting part 112 and the capacitor current value detected by the capacitor current detecting part 113 are fed to the controller 30.

The step-up/step-down converter 100 performs control to switch a step-up operation and a step-down operation in accordance with the operating states of the motor generator 12 and the turning electric motor 21, so that the DC bus voltage value detected by a DC bus voltage detecting part 111 falls within a certain range. The DC bus 110 is provided between the inverters 18 and 20 and the step-up/step-down converter 100 to transfer electric power among the capacitor 19, the motor generator 12, and the turning electric motor 21.

In the configuration as described above, the electric power generated by the motor generator 12, which is an assist motor, and the electric power regenerated by the regenerative operation of the turning electric motor 21 are supplied to the DC bus 110 of the electric energy storage system 120 via the inverter 18 and the inverter 20, respectively, to be supplied to the capacitor 19 via the step-up/step-down converter 100.

Here, a description is given of the details of the controller 30. The controller 30 includes a drive control part 32, a turning drive control part 40, and a main control part 60. Each of the drive control part 32, the turning drive control part 40, and the main control part 60 is a functional element implemented by, for example, the CPU of the controller 30 executing a drive control program contained in the internal memory.

The drive control part 32 controls the operation (switches the electric motor [assist] operation and the generator operation) of the motor generator 12. Furthermore, the drive control part 32 controls the charge and discharge of the capacitor 19 by controlling the driving of the step-up/step-down converter 100 as a step-up/step-down control part.

The turning drive control part 40 controls the driving of the turning electric motor 21 via the inverter 20.

Figure 4:
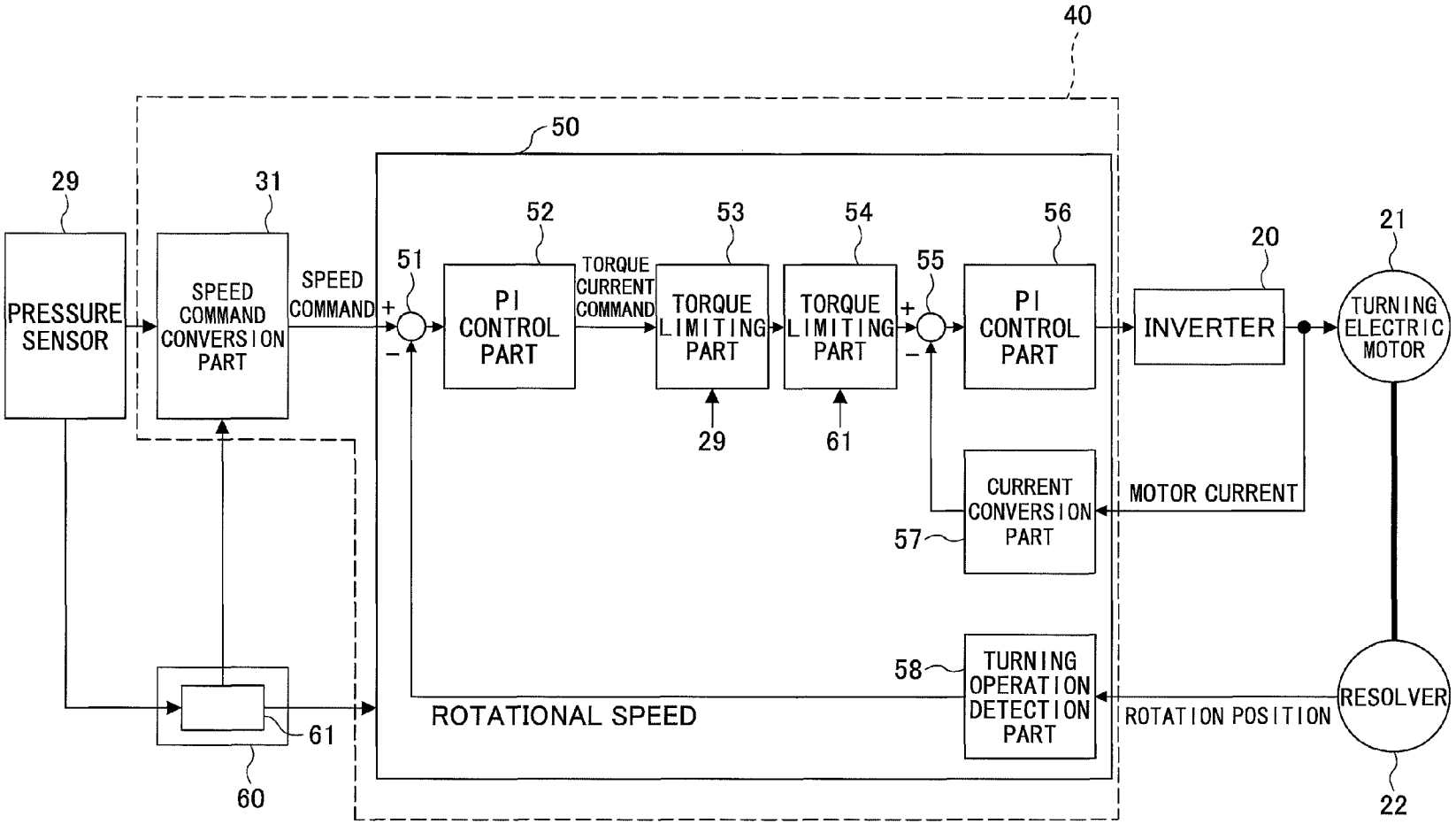
FIG. 4 is a control block diagram illustrating a configuration of a turning drive control part of a hybrid shovel according to the embodiment.

FIG. 4 is a control block diagram illustrating a configuration of the turning drive control part 40. The turning drive control part 40 includes a speed command conversion part 31 and a drive command generation part 50 that generates a drive command for driving the turning electric motor 21.

The speed command conversion part 31 is a processing part configured to convert a signal input from the pressure sensor 29 into a speed command. Thereby, the amount of operation of the turning operation lever 26A is converted into a speed command (rad/s) for causing the turning electric motor 21 to be driven to turn. This speed command is input to the drive control part 32 and the drive command generation part 50.

The speed command output from the speed command conversion part 31 in accordance with the amount of operation of the turning operation lever 26A is input to the drive command generation part 50. Furthermore, the drive command generation part 50 generates a drive command based on the speed command. The drive command output from the drive command generation part 50 is input to the inverter 20, and the inverter 20 performs AC driving of the turning electric motor 21 based on a PWM control signal based on the drive command.

The turning drive control part 40 controls the switching of a power running operation and a regenerative operation and controls the charge and discharge of the capacitor 19 via the inverter 20 in controlling the driving of the turning electric motor 21 in accordance with the amount of operation of the turning operation lever 26A.

The drive command generation part 50 includes a subtractor 51, a PI (Proportional Integral) control part 52, a torque limiting part 53, a torque limiting part 54, a subtractor 55, a PI control part 56, a current conversion part 57, and a turning operation detection part 58.

The subtractor 51 receives a speed command (rad/s) for driving the turning according to the amount of operation of the turning operation lever 26A from the speed command conversion part 31, and subtracts the rotational speed (rad/s) of the turning electric motor 21 detected by the turning operation detection part 58 from the value of the speed command (hereinafter referred to as "speed command value") to output a deviation. This deviation is used for PI control for causing the rotational speed of the turning electric motor 21 to be closer to the speed command value (target value) in the PI control part 52 described below.

The PI control part 52 performs PI control based on the deviation input from the subtractor 51 so as to cause the rotational speed of the turning electric motor 21 to be closer to the speed command value (target value) (that is, so as to reduce this deviation), and calculates and generates a torque current command necessary for that purpose. The generated torque current command is input to the torque limiting part 53.

The torque limiting part 53 performs the process of limiting the value of the torque current command (hereinafter referred to as "torque current command value") in accordance with the amount of operation of the turning operation lever 26A. This limiting process is performed based on the limitation characteristic that the allowable value (absolute value) of the torque current command value gradually increases with an increase in the amount of operation of the turning operation lever 26A. An abrupt increase in the torque current command value calculated by the PI control part 52 degrades controllability. Therefore, such limiting of the torque current command value is performed in order to prevent this. This limiting of the torque current command value is performed on both the counterclockwise and the clockwise turning of the upper-part turning body 3.

Data that represent the limitation characteristic, which are contained in the internal memory of the main control part 60, are read by the CPU of the main control part 60 to be input to the torque limiting part 53.

The torque limiting part 54 limits the torque current command value input from the torque limiting part 53 so that a torque (absolute value) generated by the torque current command input from the torque limiting part 53 is less than or equal to the maximum allowable torque value of the turning electric motor 21. Like in the torque limiting part 53, this limitation of the torque current command value is performed on both the counterclockwise and the clockwise turning of the upper-part turning body 3.

Furthermore, even when the torque (absolute value) generated by the torque current command input from the torque limiting part 53 is less than or equal to the maximum allowable torque value of the turning electric motor 21, if the size of an increase or decrease in the torque current command value in one control cycle is more than or equal to a predetermined size, the torque limiting part 54 limits the increase or decrease size to the predetermined size to prevent an abrupt increase or decrease in the torque current command value.

Thus, the torque limiting part 54 prevents an abrupt increase or decrease in the torque current command value by applying a low-pass filter to the size of an increase or decrease, that is, by employing the size of an increase or decrease less than a predetermined size as is and limiting the size of an increase or decrease more than or equal to a predetermined size to the predetermined size. As a result, the torque limiting part 54 is able to delay the turning speed of the upper-part turning body 3 reaching the speed command value (target value).

The subtractor 55 outputs a deviation obtained by subtracting the output value of the current conversion part 57 from the torque current command value input from the torque limiting part 54. This deviation is used in PI control for causing the drive torque of the turning electric motor 21 that the current conversion part 57 outputs to be closer to the torque represented by the torque current command value (target value) input via the torque limiting part 54 in a feedback loop including the PI control part 56 and the current conversion part 57 described below.

The PI control part 56 performs PI control so as to reduce the deviation that the subtractor 55 outputs, and generates a torque current command to become a final drive command to be sent to the inverter 20. The inverter 20 performs PWM driving of the turning electric motor 21 based on the torque current command input from the PI control part 56.

The current conversion part 57 detects the motor current of the turning electric motor 21, converts this into a value corresponding to the torque current command, and outputs it to the subtractor 55.

The turning operation detection part 58 detects a change in the rotation position of the turning electric motor 21 detected by the resolver 22 (that is, the turning position of the upper-part rotating body 3). Furthermore, the turning operation detection part 58 derives the rotational speed of the turning electric motor 21 from a temporal change in the rotation position through a differential operation. Data representing the derived rotational speed are input to the subtractor 51.

In the drive command generation part 50 of this configuration, a torque current command for driving the turning electric motor 21 is generated based on a speed command input from the speed command conversion part 31. As a result, the upper-part rotating body 3 is turned to a desired speed.

The main control part 60, which is a functional element that performs peripheral processing necessary for the control process of the drive command generation part 50, includes an operating state detection part 61.

The operating state detection part 61, which is a functional element for detecting the operating state of the hybrid shovel, detects operating states such as an independent turning operation state, a combined turning operation state, and a stationary state based on values detected by the pressure sensor 29. The independent turning operation state is a state where the turning electric motor 21 is caused to operate with the hydraulic actuator being held stationary. The combined turning operation state is a state where both the turning electric motor 21 and the hydraulic actuator are caused to operate. The stationary state is a state where both the turning electric motor 21 and the hydraulic actuator are held stationary. Furthermore, the pressure sensor 29 detects pilot pressures corresponding to the respective amounts of operation of the turning operation lever 26A, the hydraulic actuator operation lever 26B, and the hydraulic actuator operation pedal 26C.

The speed command conversion part 31 controls the turning speed of the upper-part turning body 3 in accordance with the operating state detected by the operating state detection part 61, and for example, limits the speed command to an independent turning operation time speed limit or a combined turning operation time speed limit. The independent turning operation time speed limit is a speed limit employed at the time of the independent turning operation. The combined turning operation time speed limit is a speed limit employed at the time of the combined turning operation.

Figure 5:
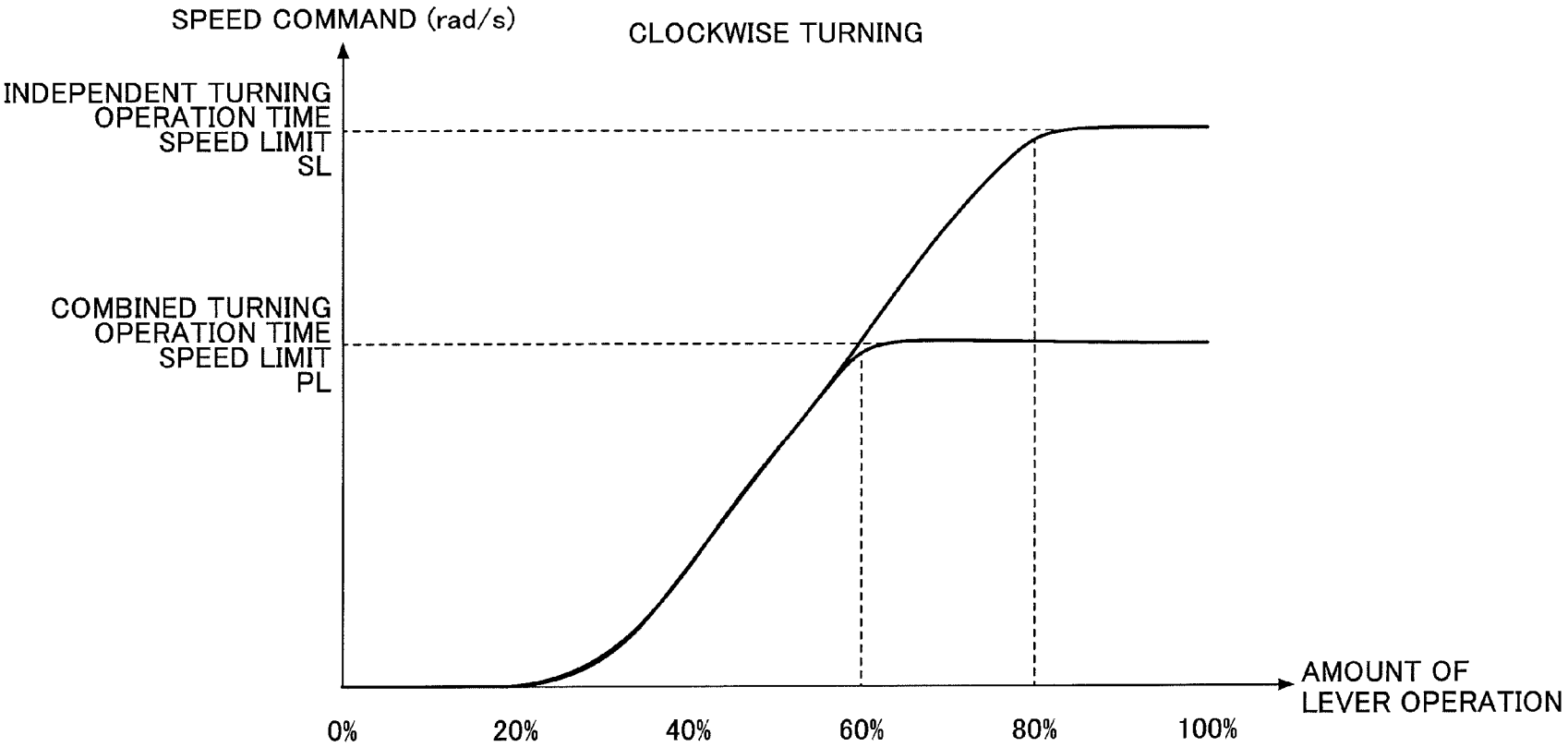
FIG. 5 is a diagram illustrating speed command limiting characteristics of a turning drive control part of a hybrid shovel according to the embodiment.

FIG. 5 is a diagram illustrating speed command limiting characteristics of the speed command conversion part 31, where the amount of operation of the turning operation lever 26A is on the horizontal axis and the speed command that the speed command conversion part 31 outputs is on the vertical axis. The amount of operation of the turning operation lever 26A is expressed as a proportion to the maximum amount of operation (the amount of operation at a full-lever operation time), which is 100%. Furthermore, FIG. 5 illustrates speed command limiting characteristics in the case of a clockwise turning, while the same applies in the case of a counterclockwise turning.

As illustrated in FIG. 5, when the amount of operation of the turning operation lever 26A is less than 60%, the speed command that the speed command conversion part 31 outputs to the drive command generation part 50 changes the same at the time of the independent turning operation and at the time of the combined turning operation and increases as the amount of operation increases.

When the amount of operation of the turning operation lever 26A is more than or equal to 60%, however, the speed command changes differently at the time of the independent turning operation and at the time of the combined turning operation as illustrated in FIG. 5.

Specifically, the speed command at the time of the independent turning operation increases as the amount of operation increases the same as in the case where the amount of operation is less than 60% when the amount of operation is less than 80%, and is limited by an independent turning operation time speed limit SL to become constant when the amount of operation becomes 80% or more.

On the other hand, the speed command at the time of the combined turning operation is limited by a combined turning operation time speed limit PL when the amount of operation becomes 60% or more, so as to become constant earlier than at the time of the independent turning operation.

In this manner, the speed command conversion part 31 is able to cause the turning speed of the upper-part turning body 3 to be lower at the time of the combined turning operation than at the time of the independent turning operation, when the amount of operation of the turning operation lever 26A is more than or equal to a predetermined amount.

Furthermore, the speed command conversion part 31 switches the speed command limiting characteristic from that for the time of the combined turning operation to that for the time of the independent turning operation when the operating state detection part 61 detects a transition from the combined turning operation state to the independent turning operation state. Even when a transition from the combined turning operation state to the independent turning operation state is detected, however, the speed command conversion part 31 may continue to use the speed command limiting characteristic for the time of the combined turning operation when the amount of operation of the turning operation lever 26A is maintained or reduced. This is for preventing the turning speed from increasing upon the transition from the combined turning operation state to the independent turning operation state although the amount of operation of the turning operation lever 26A is maintained or reduced. Even when the speed command limiting characteristic for the time of the combined turning operation continues to be used, the speed command conversion part 31 may switch the speed command limiting characteristic from that for the time of the combined turning operation to that for the time of the independent turning operation when the amount of operation of the turning operation lever 26A increases later. This is for achieving a turning speed that matches the intention of the operator.

Furthermore, the operating state detection part 61 outputs a control signal to the torque limiting part 54 so as to switch a maximum increase or decrease size that the torque limiting part 54 uses to limit the torque current command value (a maximum increase or decrease size in one control cycle for deriving the torque current command value). Hereinafter, this switching by the operating state detection part 61 is referred to as "increase/decrease size limiting process."

Specifically, the operating state detection part 61 causes the maximum increase size of the torque current command value in one control cycle to be reduced from a normal-time increase size to a transition-time increase size when detecting a transition from the combined turning operation state to the independent turning operation state. This is for preventing the turning speed from abruptly increasing in spite of no change in the amount of operation of the turning operation lever 26A when the speed command limiting characteristic is switched from that for the time of the combined turning operation to that for the time of the independent turning operation (when the speed command increases) at the time of the transition from the combined turning operation state to the independent turning operation state. The transition-time increase size is a maximum increase size that is employed when the transition of the operating state from the combined turning operation state to the independent turning operation state is made. The normal-time increase size, which is greater than the transition-time increase size, is a maximum increase size that is employed in the case other than the transition time. Accordingly, when detecting a transition from the stationary state to the independent turning operation state or the combined turning operation state, the operating state detection part 61 keeps the maximum increase size in one control cycle of the torque current command value remaining the normal-time increase size. This is for preventing an increase in the turning speed in response to an increase in the amount of operation of the turning operation lever 26A from slowing down when a transition is made from the stationary state to the independent turning operation state or the combined turning operation state.

After switching from the normal-time increase size to the transition-time increase size, the operating state detection part 61 causes the maximum increase size in one control cycle of the torque current command value to return from the transition-time increase size to the normal-time increase size when detecting a transition from the independent turning operation state to the stationary state. Furthermore, the operating state detection part 61 may cause the maximum increase size in one control cycle of the torque current command value to return from the transition-time increase size to the normal-time increase size when there is a decrease in the amount of operation of the turning operation lever 26A in the independent turning operation state. This is for enabling a swift increase in the turning speed when the turning operation lever 26A is later operated to increase the turning speed.

The operating state detection part 61 may cause the maximum decrease size in one control cycle of the torque current command value to be reduced from a normal-time decrease size to a transition-time decrease size when detecting a transition from the independent turning operation state to the combined turning operation state. This is for preventing the turning speed from abruptly decreasing in spite of no change in the amount of operation of the turning operation lever 26A when the speed command limiting characteristic is switched from that for the time of the independent turning operation to that for the time of the combined turning operation (when the speed command decreases) at the time of the transition from the independent turning operation state to the combined turning operation state. The transition-time decrease size is a maximum decrease size that is employed when the transition of the operating state from the independent turning operation state to the combined turning operation state is made. The normal-time decrease size, which is greater than the transition-time decrease size, is a maximum decrease size that is employed in the case other than the transition time.

In this manner, the operating state detection part 61 is able to prevent the turning speed from abruptly increasing or decreasing when the combined turning operation state and the independent turning operation state are switched.

Figure 6:
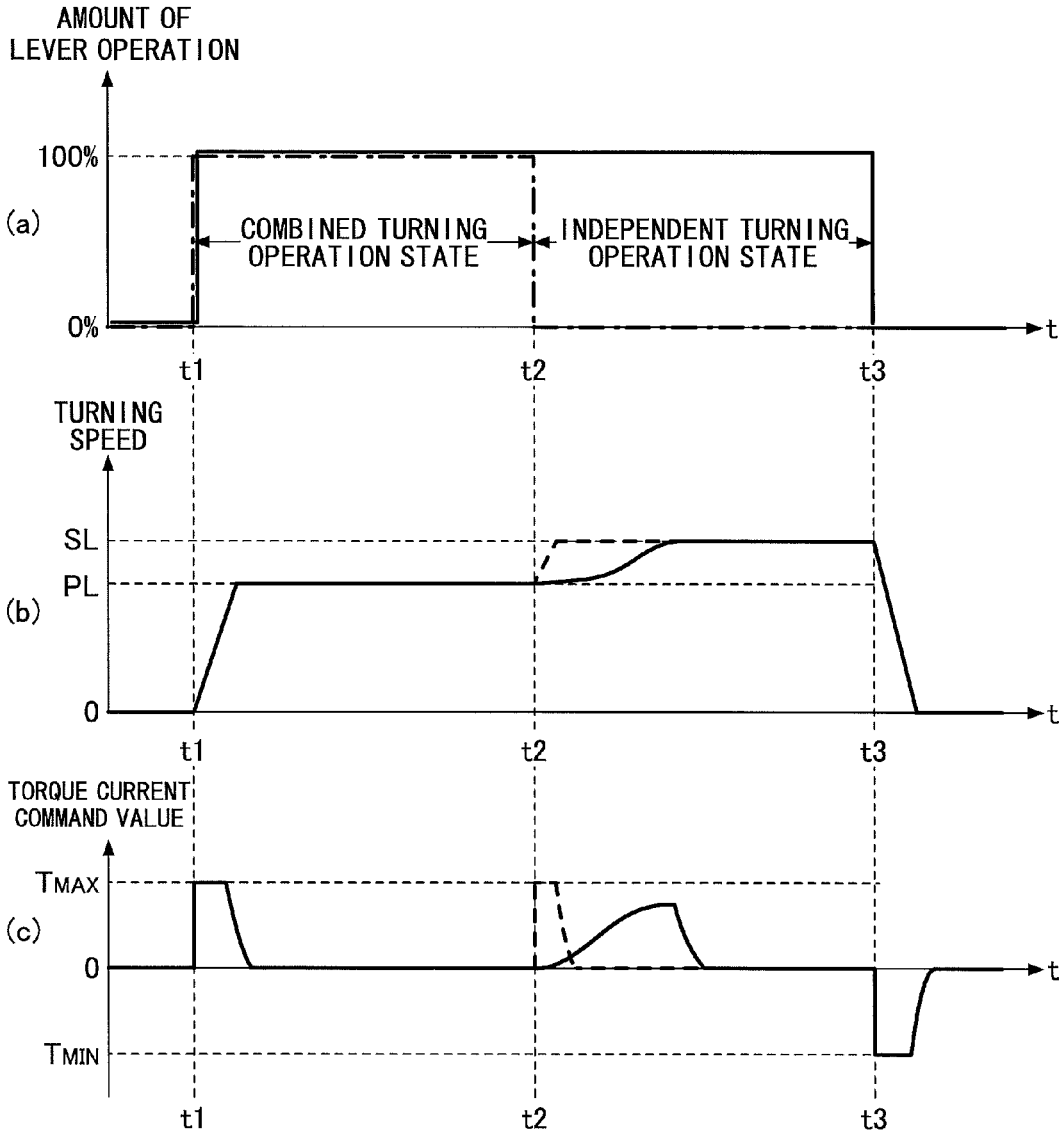
FIG. 6 is a diagram illustrating temporal changes in various physical quantities at a time when the operating state of a hybrid shovel makes a transition from a combined turning operation state to an independent turning operation state according to the embodiment.

Here, a description is given, with reference to FIG. 6, of temporal changes in various physical quantities (the amounts of operation of the turning operation lever 26A and the hydraulic actuator [boom] operation lever 26B [see (a) of FIG. 6], the turning speed [see (b) of FIG. 6], and the torque current command value [see (c) of FIG. 6]) at the time when the operating state of the hybrid shovel makes a transition from the combined turning operation state to the independent turning operation state. The changes indicated by a solid line in (a) of FIG. 6 illustrate changes in the amount of operation of the turning operation lever 26A. The changes indicated by a dot-dash line in (a) of FIG. 6 illustrate changes in the amount of operation of the boom operation lever 26B. Furthermore, the respective changes indicated by solid lines in (b) of FIG. 6 and (c) of FIG. 6 illustrate effects in the case where the increase/decrease size limiting process by the operating state detection part 61 is executed. Furthermore, the respective changes indicated by broken lines in (b) of FIG. 6 and (c) of FIG. 6 illustrate results in the case where the increase/decrease size limiting process by the operating state detection part 61 is not executed.

At Time t1, when the turning operation lever 26A and the boom operation lever 26B are both operated with a maximum operation amount of 100% so that the combined turning operation is started, the speed command that the speed command conversion part 31 outputs is set to the combined turning operation time speed limit PL. The torque current command value that the drive command generation part 50 generates abruptly increases to reach a maximum allowable torque value $T_{MAX}$. As a result, the turning speed of the upper-part turning body 3 abruptly increases to the combined turning operation time speed limit PL, and remains at the combined turning operation time speed limit PL after reaching the combined turning operation time speed limit PL. The torque current command value is near zero when the turning speed of the upper-part turning body 3 reaches the combined turning operation time speed limit PL.

Thereafter, at Time t2, when the amount of operation of the boom operation lever 26B becomes 0% so that the operating state of the shovel makes a transition from the combined turning operation state to the independent turning operation state, the speed command is switched from the combined turning operation time speed limit PL to the independent turning operation time speed limit SL even when the amount of operation of the turning operation lever 26A remains unchanged at 100%. Furthermore, because the maximum increase size of the torque current command value is reduced to the transition-time increase size in the torque liming part 54, the torque current command value moderately increases compared with the abrupt increase at the start of the combined turning operation. Thus, the controller 30 limits the output of the turning electric motor 21 after the transition from the combined turning operation state to the independent turning operation state to an output smaller than the output of the turning electric motor 21 in the independent turning operation state other than that after the transition. As a result, the turning speed of the upper-part turning body 3 moderately increases to the independent turning operation time speed limit SL compared with the abrupt change at the start of the combined turning operation, and remains at the independent turning operation time speed limit SL after reaching the independent turning operation time speed limit SL. The torque current command value starts to decrease without reaching the maximum allowable torque value $T_{MAX}$, and is near zero when the turning speed of the upper-part turning body 3 reaches the independent turning operation time speed limit SL.

Thereafter, at Time t3, when the amount of operation of the turning operation lever 26A becomes 0% so that the operating state of the shovel makes a transition from the independent turning operation state to the stationary state, the speed command is switched from the independent turning operation time speed limit SL to zero.

The torque current command value abruptly decreases to a minimum allowable torque value $T_{MIN}$ (a negative value). As a result, the turning speed of the upper-part turning body 3 abruptly decreases to a speed of zero, and remains at the speed of zero after reaching the speed of zero. The torque current command value becomes zero when the turning speed of the upper-part turning body 3 reaches the speed of zero.

In the case where the increase/decrease size limiting process by the operating state detection part 61 is not executed, in response to the switching of the speed command from the combined turning operation time speed limit PL to the independent turning operation time speed limit SL at Time t2, the torque current command value abruptly increases in the same manner as it abruptly increases at the start of the combined turning operation to reach the maximum allowable torque value $T_{MAX}$ (see the broken line in (c) of FIG. 6). As a result, the turning speed of the upper-part turning body 3 as well abruptly increases in the same manner as it abruptly increases at the start of the combined turning operation to reach the independent turning operation time speed limit SL (see the broken line in (b) of FIG. 6).

As is clear from the above description, when the transition of the operating state from the combined turning operation state to the independent turning operation state is made, the hybrid shovel according to this embodiment causes the turning speed to increase by causing a speed command corresponding to the amount of operation of the turning operation lever 26A to increase even when the amount of operation is unchanged. As a result, the hybrid shovel according to this embodiment is able to imitatively realize the operability of a hydraulic shovel that the fluid discharged by a hydraulic pump is intensively supplied to a turning hydraulic actuator to increase the turning speed when the transition of the operating state from the combined turning operation state to the independent turning operation state is made. As a result, it is possible to eliminate a feeling of strangeness that an operator accustomed to operating a hydraulic shovel develops in operating the hybrid shovel (a feeling of strangeness that there is no increase in the turning speed even when the transition of the operating state from the combined turning operation state to the independent turning operation state is made).

Furthermore, the hybrid shovel according to this embodiment causes the turning speed to gradually increase at the time of the transition from the combined turning operation state to the independent turning operation state. As a result, the hybrid shovel according to this embodiment is able to eliminate a feeling of strangeness that an operation develops because of an abrupt increase in the turning speed at the time of the transition from the combined turning operation state to the independent turning operation state.

Next, a description is given, with reference to

Figure 7:
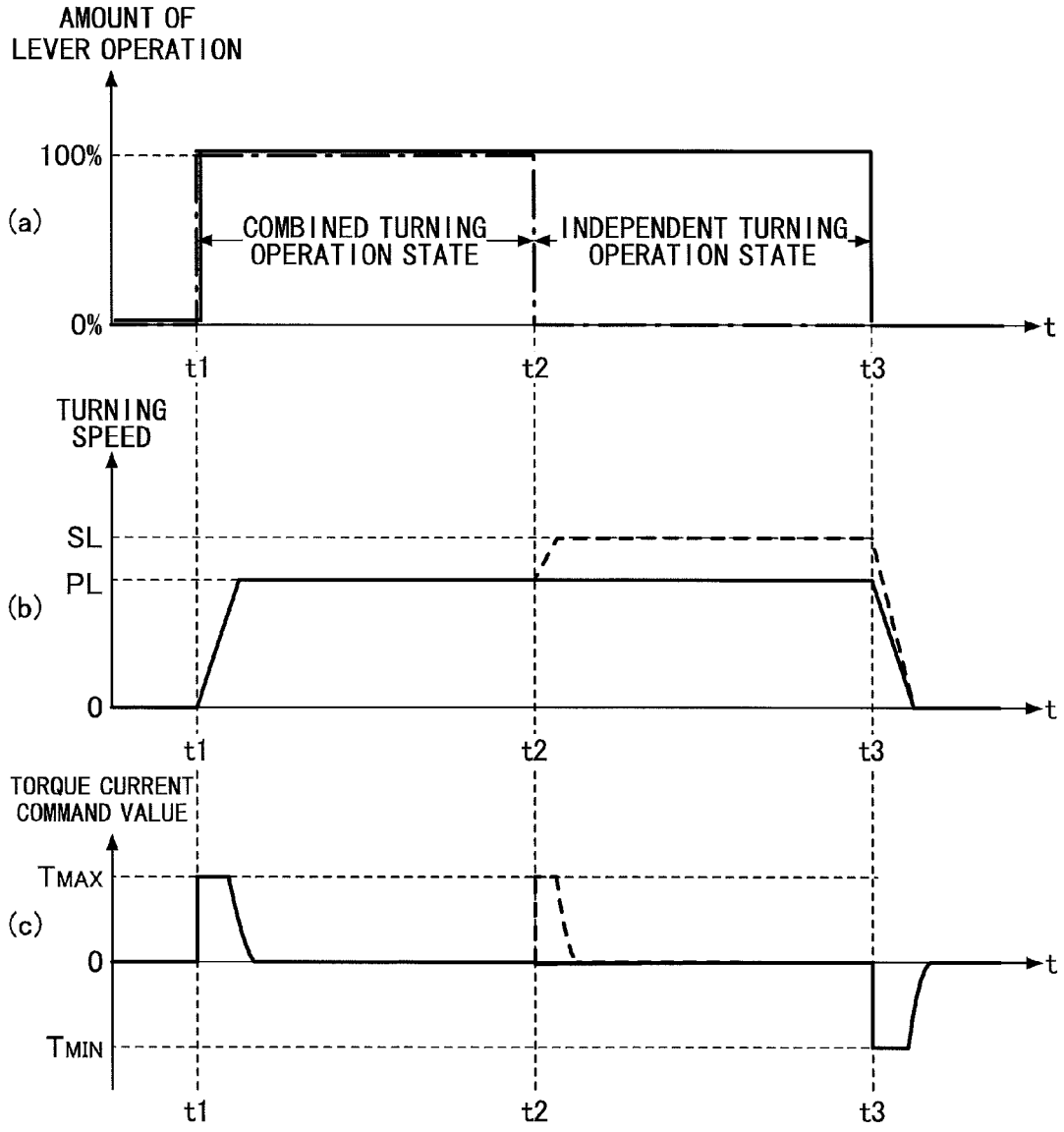
FIG. 7 is a diagram illustrating temporal changes in various physical quantities at a time when the operating state of a hybrid shovel makes a transition from a combined turning operation state to an independent turning operation state according to another embodiment.

FIG. 7, of a hybrid shovel according to another embodiment of the present invention.

The hybrid shovel according to this embodiment is the same as the hybrid shovel according to the above-described embodiment except for preventing the switching of the speed limit of the speed command at the time of the transition from the combined turning operation state to the independent turning operation state.

Therefore, a description is given in detail of differences while omitting a description of what they have in common. Here, the reference numerals employed in the above-described embodiment continue to be employed.

In this embodiment, even when a transition from the combined turning operation state to the independent turning operation state is detected by the operating state detection part 61, the speed command conversion part 31 continues to use the speed command limiting characteristic for the time of the combined turning operation when the amount of operation of the turning operation lever 26A is maintained or reduced. Hereinafter, this process by the speed command conversion part 31 is referred to as "limiting characteristic maintaining process."

FIG. 7 is a diagram corresponding to FIG. 6, and illustrates temporal changes in various physical quantities (the amounts of operation of the turning operation lever 26A and the boom operation lever 26B [see (a) of FIG. 7], the turning speed [see (b) of FIG. 7], and the torque current command value [see (c) of FIG. 7]) at the time when the operating state of the hybrid shovel according to this embodiment makes a transition from the combined turning operation state to the independent turning operation state. The changes indicated by a solid line in (a) of FIG. 7 illustrate changes in the amount of operation of the turning operation lever 26A. The changes indicated by a dot-dash line in (a) of FIG. 7 illustrate changes in the amount of operation of the boom operation lever 26B. Furthermore, the respective changes indicated by solid lines in (b) of FIG. 7 and (c) of FIG. 7 illustrate effects in the case where the limiting characteristic maintaining process by the speed command conversion part 31 is executed. Furthermore, the respective changes indicated by broken lines in (b) of FIG. 7 and (c) of FIG. 7 illustrate results in the case where neither the increase/decrease size limiting process by the operating state detection part 61 nor the limiting characteristic maintaining process by the speed command conversion part 31 is executed.

At Time t1, when the turning operation lever 26A and the boom operation lever 26B are both operated with a maximum operation amount of 100% so that the combined turning operation is started, the speed command that the speed command conversion part 31 outputs is set to the combined turning operation time speed limit PL. The torque current command value that the drive command generation part 50 generates abruptly increases to reach a maximum allowable torque value T. As a result, the turning speed of the upper-part turning body 3 abruptly increases to the combined turning operation time speed limit PL, and remains at the combined turning operation time speed limit PL after reaching the combined turning operation time speed limit PL. The torque current command value is near zero when the turning speed of the upper-part turning body 3 reaches the combined turning operation time speed limit PL.

Thereafter, at Time t2, when the amount of operation of the boom operation lever 26B becomes 0% so that the transition of the operating state of the shovel from the combined turning operation state to the independent turning operation state is made, the speed command remains at the combined turning operation time speed limit PL because the amount of operation of the turning operation lever 26A remains unchanged at 100%. Furthermore, because the turning speed is already the combined turning operation time speed limit PL, the torque current command value remains near zero. Thus, the controller 30 limits the output of the turning electric motor 21 after the transition from the combined turning operation state to the independent turning operation state to an output smaller than the output of the turning electric motor 21 in the independent turning operation state other than that after the transition. As a result, the turning speed of the upper-part turning body 3 remains at the combined turning operation time speed limit PL after the transition to the independent turning operation state as well. In this case, the torque limiting part 54 may not be provided because the turning speed is limited to the combined turning operation time speed limit PL.

Thereafter, at Time t3, when the amount of operation of the turning operation lever 26A becomes 0% so that the operating state of the shovel makes a transition from the independent turning operation state to the stationary state, the speed command is switched from the combined turning operation time speed limit PL to zero. The torque current command value abruptly decreases to a minimum allowable torque value $T_{MIN}$ (a negative value). As a result, the turning speed of the upper-part turning body 3 abruptly decreases to a speed of zero, and remains at the speed of zero after reaching the speed of zero. The torque current command value becomes zero when the turning speed of the upper-part turning body 3 reaches the speed of zero.

In the case where neither the increase/decrease size limiting process by the operating state detection part 61 nor the limiting characteristic maintaining process by the speed command conversion part 31 is executed, in response to the switching of the speed command from the combined turning operation time speed limit PL to the independent turning operation time speed limit SL at Time t2, the torque current command value abruptly increases in the same manner as it abruptly increases at the start of the combined turning operation to reach the maximum allowable torque value $T_{MAX}$ (see the broken line in (c) of FIG. 7). As a result, the turning speed of the upper-part turning body 3 as well abruptly increases in the same manner as it abruptly increases at the start of the combined turning operation to reach the independent turning operation time speed limit SL (see the broken line in (b) of FIG. 7).

As is clear from the above description, even when the transition of the operating state from the combined turning operation state to the independent turning operation state is made, the hybrid shovel according to this embodiment prevents the turning speed from increasing by continuing to use the speed command limiting characteristic for the time of the combined turning operation when the amount of operation of the turning operation lever 26A is maintained or reduced. As a result, the hybrid shovel according to this embodiment is able to eliminate a feeling of strangeness that the operator develops because of an increase in the turning speed in spite of no increase in the amount of operation of the turning operation lever 26A at the time of the transition from the combined turning operation state to the independent turning operation state.

Figure 8:
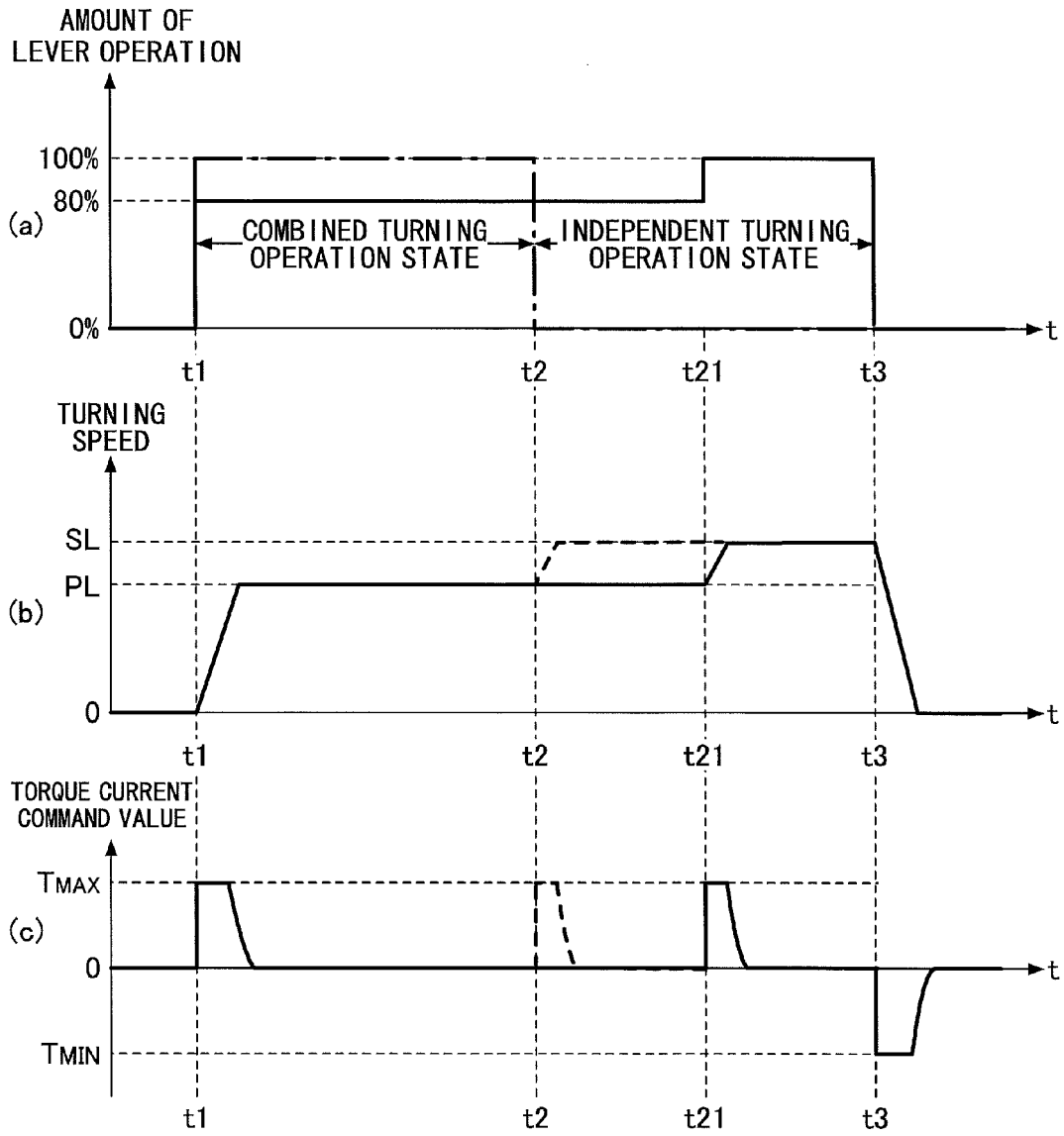
FIG. 8 is a diagram illustrating temporal changes in various physical quantities at a time when the operating state of a hybrid shovel makes a transition from a combined turning operation state to an independent turning operation state according to yet another embodiment.

Next, a description is given, with reference to FIG. 8, of a hybrid shovel according to yet another embodiment of the present invention.

The hybrid shovel according to this embodiment is the same as the hybrid shovel according to the above-described other embodiment except for switching the speed limit of the speed command at the time of a transition from the combined turning operation state to the independent turning operation state when the amount of operation of the turning operation lever 26A increases later, even in the case where the switching is prevented.

Therefore, a description is given in detail of differences while omitting a description of what they have in common. Here, the reference numerals employed in the above-described embodiments continue to be employed.

In this embodiment, in the case where the amount of operation of the turning operation lever 26A is maintained or reduced when a transition from the combined turning operation state to the independent turning operation state is detected by the operating state detection part 61, the speed command conversion part 31 continues to use the speed command limiting characteristic for the time of the combined turning operation. Furthermore, when the amount of operation of the turning operation lever 26A is later increased, the speed command conversion part 31 switches the speed command limiting characteristic for the time of the combined turning operation to the speed command limiting characteristic for the time of the independent turning operation. Hereinafter, this process by the speed command conversion part 31 is referred to as "limiting characteristic switching delaying process."

FIG. 8 is a diagram corresponding to FIG. 6 and FIG. 7, and illustrates temporal changes in various physical quantities (the amounts of operation of the turning operation lever 26A and the boom operation lever 26B [see (a) of FIG. 8], the turning speed [see (b) of FIG. 8], and the torque current command value [see (c) of FIG. 8]) at the time when the operating state of the hybrid shovel according to this embodiment makes a transition from the combined turning operation state to the independent turning operation state. The changes indicated by a solid line in (a) of FIG. 8 illustrate changes in the amount of operation of the turning operation lever 26A. The changes indicated by a dot-dash line in (a) of FIG. 8 illustrate changes in the amount of operation of the boom operation lever 26B. Furthermore, the respective changes indicated by solid lines in (b) of FIG. 8 and (c) of FIG. 8 illustrate effects in the case where the limiting characteristic switching delaying process by the speed command conversion part 31 is executed. Furthermore, the respective changes indicated by broken lines in (b) of FIG. 8 and (c) of FIG. 8 illustrate results in the case where the limiting characteristic switching delaying process by the speed command conversion part 31 is not executed.

At Time t1, when the turning operation lever 26A is operated with an amount of operation of 80% and the boom operation lever 26B is operated with a maximum operation amount of 100% so that the combined turning operation is started, the speed command that the speed command conversion part 31 outputs is set to the combined turning operation time speed limit PL. The torque current command value that the drive command generation part 50 generates abruptly increases to reach a maximum allowable torque value T. As a result, the turning speed of the upper-part turning body 3 abruptly increases to the combined turning operation time speed limit PL, and remains at the combined turning operation time speed limit PL after reaching the combined turning operation time speed limit PL. The torque current command value is near zero when the turning speed of the upper-part turning body 3 reaches the combined turning operation time speed limit PL.

Thereafter, at Time t2, the amount of operation of the boom operation lever 26B becomes 0% so that the operating state of the shovel makes a transition from the combined turning operation state to the independent turning operation state. In this case, the speed command remains at the combined turning operation time speed limit PL although the amount of operation of the turning operation lever 26A remains unchanged at 80%. Furthermore, because the turning speed is already at the combined turning operation time speed limit PL, the torque current command value remains near zero. Thus, the controller 30 limits the output of the turning electric motor 21 after the transition from the combined turning operation state to the independent turning operation state to an output smaller than the output of the turning electric motor 21 in the independent turning operation state other than that after the transition. As a result, the turning speed of the upper-part turning body 3 remains at the combined turning operation time speed limit PL after the transition to the independent turning operation state as well. In this case, the torque limiting part 54 may not be provided because the turning speed is limited to the combined turning operation time speed limit PL.

Thereafter, at Time t21, when the amount of operation of the turning operation lever 26A increases from 80% to 100%, the speed command is switched from the combined turning operation time speed limit PL to the independent turning operation time speed limit SL. The torque current command value increases to reach a maximum allowable torque value T. Thus, the controller 30 removes the limitation on the output of the turning electric motor 21. As a result, the turning speed of the upper-part turning body 3 as well abruptly increases in the same manner as it abruptly increases at the start of the combined turning operation to reach the independent turning operation time speed limit SL.

Thereafter, at Time t3, when the amount of operation of the turning operation lever 26A becomes 0% so that the operating state of the shovel makes a transition from the independent turning operation state to the stationary state, the speed command is switched from the independent turning operation time speed limit SL to zero. The torque current command value abruptly decreases to a minimum allowable torque value $T_{MIN}$ (a negative value). As a result, the turning speed of the upper-part turning body 3 abruptly decreases to a speed of zero, and remains at the speed of zero after reaching the speed of zero. The torque current command value becomes zero when the turning speed of the upper-part turning body 3 reaches the speed of zero.

In the case where the limiting characteristic switching delaying process by the speed command conversion part 31 is not executed, in response to the switching of the speed command from the combined turning operation time speed limit PL to the independent turning operation time speed limit SL at Time t2, the torque current command value abruptly increases in the same manner as it abruptly increases at the start of the combined turning operation to reach the maximum allowable torque value $T_{MAX}$ (see the broken line in (c) of FIG. 8). As a result, the turning speed of the upper-part turning body 3 as well abruptly increases in the same manner as it abruptly increases at the start of the combined turning operation to reach the independent turning operation time speed limit SL (see the broken line in (b) of FIG. 8).

As is clear from the above description, even when the transition of the operating state from the combined turning operation state to the independent turning operation state is made, the hybrid shovel according to this embodiment prevents the turning speed from increasing by continuing to use the speed command limiting characteristic for the time of the combined turning operation when the amount of operation of the turning operation lever 26A is maintained or reduced. As a result, the hybrid shovel according to this embodiment is able to eliminate a feeling of strangeness that the operator develops because of an increase in the turning speed in spite of no increase in the amount of operation of the turning operation lever 26A at the time of the transition from the combined turning operation state to the independent turning operation state.

Furthermore, even when the speed command limiting characteristic for the time of the combined turning operation continues to be used after the transition from the combined turning operation state to the independent turning operation state, the hybrid shovel according to this embodiment switches the speed command limiting characteristic for the time of the combined turning operation to the speed command limiting characteristic for the time of the independent turning operation when the amount of operation of the turning operation lever 26A increases later. As a result, while preventing a sudden increase in the turning speed at the time of a transition from the combined turning operation state to the independent turning operation state, the hybrid shovel according to this embodiment is able to realize a turning speed more suited to the intention of the operator by increasing the turning speed to the independent turning operation time speed limit SL beyond the combined turning operation time speed limit PL when the amount of operation of the turning operation lever 26A increases later.

In the above-described embodiments, the speed command at the time of the combined turning operation is limited in the speed command conversion part 31 as illustrated in FIG. 5. Alternatively, the torque current command value at the time of the combined turning operation may be limited in the torque limiting part 53. Thus, the controller 30 is able to limit the output of the turning electric motor 21 (which is, for example, a drive torque) at the time when a transition from the combined turning operation state to the independent turning operation state is made.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

For example, the above-described embodiments, which are directed to the case of application to the hybrid shovel including the bucket 6, may also be applied to hybrid work machines including a lifting magnet, a breaker, a fork or the like.

What is claimed is:

1. A hybrid work machine, comprising:

a turning electric motor configured to turn an upper-part turning body;

a hydraulic actuator; and a controller including a processor; and a memory storing a program that, when executed by the processor, causes the controller to control turning in a state of an independent turning operation in which the turning electric motor operates with the hydraulic actuator being held stationary and in a state of a combined turning operation in which the turning electric motor and the hydraulic actuator operate together, wherein the controller is caused to detect a transition from the state of the combined turning operation to the state of the independent turning operation, and in response to detecting the transition, limit an output power of the turning electric motor in the state of the independent turning operation after the transition to a value smaller than an output power of the turning electric motor in the state of the independent turning operation that is not after the transition.

2. The hybrid work machine as claimed in claim 1, wherein the controller is further caused to moderate an increase in turning speed by limiting a torque caused to be generated by the turning electric motor, in the state of the independent turning operation after the transition.

3. The hybrid work machine as claimed in claim 1, wherein the controller is further caused to generate a speed command corresponding to an amount of operation of a turning operation lever;

generate a torque current command based on the speed command and a current turning speed; and moderate an increase in turning speed by applying a filter to an increase size of the torque current command in the state of the independent turning operation after the transition.

4. The hybrid work machine as claimed in claim 1, further comprising:

a detector configured to detect an amount of operation of a turning operation lever, wherein the controller is further caused to determine whether to limit the output power of the turning electric motor in the state of the independent turning operation after the transition to the value smaller than the output power of the turning electric motor in the state of the independent turning operation that is not after the transition based on the detected amount of operation at a time of the transition.

5. The hybrid work machine as claimed in claim 4, wherein the controller is further caused to determine to limit the output power of the turning electric motor when the amount of operation is unchanged or reduced at the time of the transition.

6. The hybrid work machine as claimed in claim 5, wherein the controller is further caused to remove a limitation on the output power of the turning electric motor when the amount of operation increases after the time of the transition.

7. A method of controlling a hybrid work machine including a turning electric motor configured to turn an upper-part turning body, a hydraulic actuator, and a controller including a processor and a memory storing a program that, when executed by the processor, causes the controller to control turning in a state of an independent turning operation in which the turning electric motor operates with the hydraulic actuator being held stationary and in a state of a combined turning operation in which the turning electric motor and the hydraulic actuator operate together, the method comprising:

detecting, by the controller, a transition from the state of the combined turning operation to the state of the independent turning operation; and limiting, by the controller, in response to detecting the transition, an output power of the turning electric motor in the state of the independent turning operation after the transition to a value smaller than an output power of the turning electric motor in the state of the independent turning operation that is not after the transition.

8. The method of controlling a hybrid work machine as claimed in claim 7, further comprising:

moderating, by the controller, an increase in turning speed by limiting a torque caused to be generated by the turning electric motor, in the state of the independent turning operation after the transition.

9. The method of controlling a hybrid work machine as claimed in claim 7, further comprising:

generating, by the controller, a speed command corresponding to an amount of operation of a turning operation lever;

generating, by the controller, a torque current command based on the speed command and a current turning speed; and moderating, by the controller, an increase in turning speed by applying a filter to an increase size of the torque current command in the state of the independent turning operation after the transition.

10. The method of controlling a hybrid work machine as claimed in claim 7, further comprising:

detecting, by a detector of the hybrid work machine, an amount of operation of a turning operation lever, and determining, by the controller, whether to limit the output power of the turning electric motor in the state of the independent turning operation after the transition to the value smaller than the output power of the turning electric motor in the state of the independent turning operation that is not after the transition based on the detected amount of operation at a time of the transition.

11. The method of controlling a hybrid work machine as claimed in claim 10, wherein, in said determining step, the controller determines to limit the output power of the turning electric motor when the amount of operation is unchanged or reduced at the time of the transition.

12. The method of controlling a hybrid work machine as claimed in claim 11, further comprising:

removing, by the controller, a limitation on the output power of the turning electric motor when the amount of operation increases after the time of the transition.

* * * * *